United States Patent [19]

Sato

[11] Patent Number: 4,499,822

[45] Date of Patent: Feb. 19, 1985

[54] CONTINUOUS PRESS

[75] Inventor: Hachiro Sato, Tokyo, Japan

[73] Assignee: Fukoku Kogyo Company Limited, Tokyo, Japan

[21] Appl. No.: 526,150

[22] Filed: Aug. 24, 1983

[30] Foreign Application Priority Data

Sep. 10, 1982 [JP] Japan ..... 57-157744

[51] Int. Cl.[3] ..... B30B 9/16

[52] U.S. Cl. ..... 100/117; 100/148

[58] Field of Search ..... 100/117, 146–149; 366/77, 76, 79, 88, 89, 91, 192, 193, 321, 323, 327; 159/2 E; 425/208, 209

[56] References Cited

U.S. PATENT DOCUMENTS

| | | | |
|---|---|---|---|
| 3,224,739 | 12/1965 | Schuur | 366/321 X |
| 3,939,763 | 2/1976 | Sato | 100/117 X |
| 3,991,668 | 11/1976 | De Mitt et al. | 100/147 X |
| 4,003,304 | 1/1977 | Reinhall | 100/148 X |

FOREIGN PATENT DOCUMENTS

| | | | |
|---|---|---|---|
| 588998 | 2/1959 | Italy | 100/147 |

*Primary Examiner*—Peter Feldman

*Attorney, Agent, or Firm*—Koda and Androlia

[57] ABSTRACT

In a continuous press of a screw blade type, a driving shaft is rotatably secured to a frame by means of thrust bearings at both ends of the driving shaft, a screw drum having an increasing diameter towards center is disposed around the driving shaft to rotate therewith, a pair of screw blades are helically arranged around the screw drum symmetrically with respect to the center of screw drum, and an outer drum having a number of small filtering holes is arranged around the screw blades. A pair of inlets for introducing raw materials to be pressed are provided at both ends of the outer drum and an outlet from which the pressed raw materials are discharged is also provided in the outer drum at its center. Since repelling forces applied to the screw blades are cancelled each other, no thrust force is applied to the driving shaft and the bearing.

2 Claims, 1 Drawing Figure

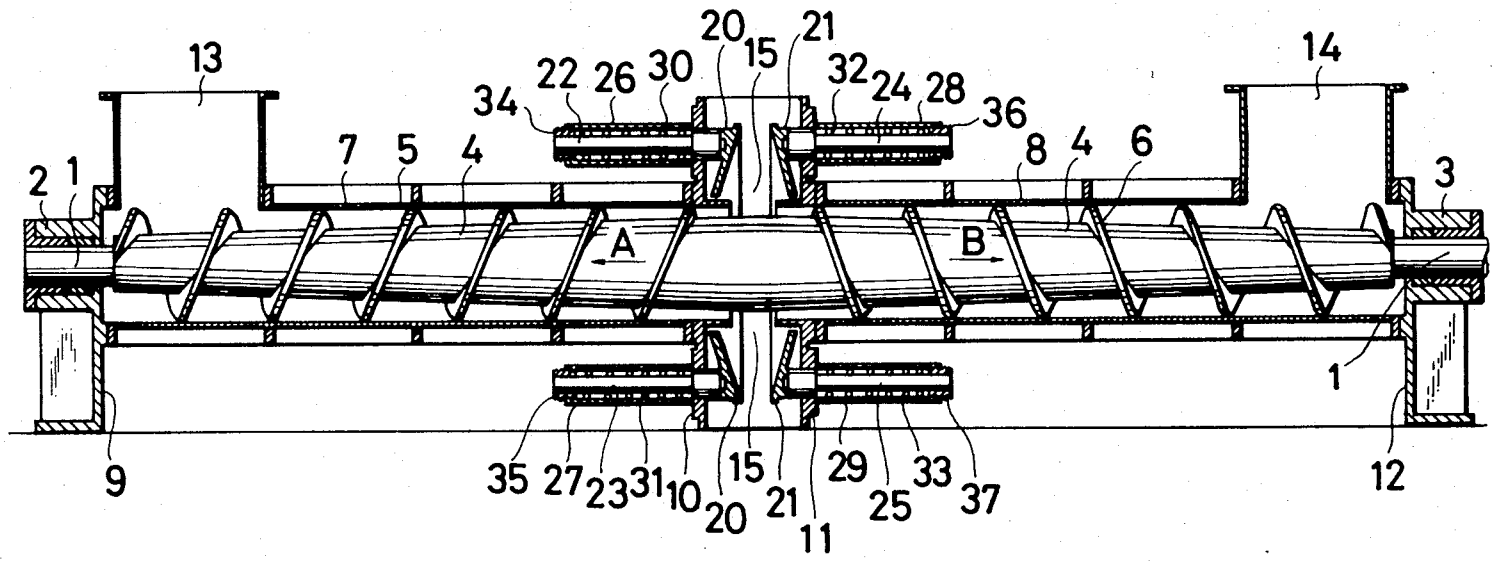
3
14
6
4
8
36
28
24
32
21
15
20
30
26
22
34
4
5
7
13
2
1
12
1
37
33
25
29
11
21
15
20
10
31
23
27
35
9
B
A

CONTINUOUS PRESS

BACKGROUND OF THE INVENTION

The present invention relates to a continuous press comprising a frame, a driving shaft journaled to the frame at its both ends by means of thrust bearings, a screw drum disposed around the driving shaft to rotate therewith, a screw blade arranged helically around the outer surface of the screw drum, an outer drum arranged around the screw blade and having a number of small filtering holes, an inlet provided in the outer drum for introducing raw materials into a space between the screw drum and outer drum and an outlet provided in the outer drum for discharging the pressed materials as a cake, whereby said space is gradually made smaller in a direction from said inlet to said outlet.

Such a continuous press has been known from, for example U.S. Pat. No. 3,939,763 and can be effectively utilized to press continuously water, oils and fats out of various kinds of raw materials. In the known continuous press, a repelling force generated by the pressing is applied to the screw shaft via the screw blade and screw drum and therefore, the thrust bearings are subjected to the very strong thrust force. This requires large and strong thrust bearings, so that the cost is increased. Further, the usable duration of the thrust bearings becomes short and the bearings must be repaired so often. Thus, in the known continuous press the maintenance is very cumbersome.

SUMMARY OF THE INVENTION

The present invention has for its object to provide a novel and useful continuous press of the kind mentioned in the preamble, which needs only small thrust bearings without decreasing the efficiency of pressing.

According to the invention, a continuous press comprises a frame; a driving shaft journaled to the frame at its both ends by means of thrust bearings; a screw drum disposed around the driving shaft to rotate therewith; first and second screw blades symmetrically disposed around the outer surface of screw drum, turning directions of the first and second screw blades being opposite to each other; an outer drum arranged around the screw blades and having a number of small filtering holes; first and second inlets provided in said outer drum at its both ends for introducing raw materials into first and second spaces formed by the screw drum, first and second screw blades and outer drum, said spaces being gradually made smaller towards a center of the screw drum; an outlet provided in said outer drum at its center for discharging the pressed raw materials as cakes.

BRIEF DESCRIPTION OF THE DRAWINGS

A sole FIGURE is a cross sectional view showing an embodiment of the continuous press according to the invention.

DESCRIPTION OF THE PREFERRED EMBODIMENTS

The FIGURE shows an embodiment of the continuous press according to the invention. The press comprises a driving shaft 1 which is journalled at its both ends by thrust bearings 2 and 3 and is rotated by an electric motor not shown via a suitable mechanism. Around the driving shaft 1 is secured a screw drum 4 made of a metal drum which is so tapered that its diameter is gradually smaller towards both ends thereof.

Around the outer surface of the screw drum 4 are arranged symmetrically a pair of screw blades 5 and 6. These screw blades have a constant pitch, but their twisting directions are opposite to each other. The outer diameter of the screw blades is uniform over their length. Around the screw blades is arranged outer drums 7 and 8 having a number of small filtering holes. Both ends of the outer drums 7 and 8 are secured to frame members 9, 10, 11 and 12. At outer extreme ends of the outer drums 7 and 8 are formed first and second inlets 13 and 14 from which raw materials to be pressed are supplied into the press. Further, a center outlet 15 is formed between the outer drums 7 and 8 through which a cake is discharged. The raw materials supplied from the inlets 13 and 14 are introduced into spaces formed by the screw drum 4, screw blades 5 and 6 and outer drums 7 and 8. These spaces are gradually decreased towards the center outlet 15. Therefore, the raw materials are transported towards the center outlet 15 by means of the rotating screw blades 5 and 6, and during this transportation, the raw materials are pressed to a gradually increasing extent.

In the present embodiment, at the outlet 15 between the outer drums 7 and 8, there are symmetrically arranged shallow cone-shaped plates 20 and 21 each having a large apex angle in such a manner that their outer peripheries having a larger diameter face each other. To the cone-shaped plates 20 and 21 are secured supporting shafts 22, 23 and 24, 25, respectively which are then movably inserted into guide sleeves 26, 27 and 28, 29, respectively. The guide sleeves 26 and 27 are secured to the frame member 10 and the guide sleeves 28 and 29 are secured to the frame member 11. Thus, the cone-shaped plates 20 and 21 are movable in a direction of the driving shaft 1. In the guide sleeves 26, 27, 28 and 29 are inserted coiled springs 30, 31, 32 and 33, respectively so as to compress the supporting shafts 22, 23, 24 and 25, and thus the cone-shaped plates 20 and 21 towards the center of the press. At the outer ends of the guide sleeves 26, 27, 28 and 29 are threaded adjusting screws 34, 35, 36 and 37, respectively, so that the compressing force of the springs 30, 31, 32 and 33 are made adjustable by means of the screws 34, 35, 36 and 37. In this manner, the compressing force applied to the cake during the operation can be set to a desired value.

In the continuous press of the present embodiment, when the driving shaft 1 is rotated at a given speed, the screw drum 4 and thus the screw blades 5 and 6 are rotated in such a manner that the raw materials introduced from the first inlet 13 is transported rightwards, but the raw materials supplied from the second inlet 14 are transported leftwards. During the transportation, the raw materials are gradually pressed due to the decrease in the spaces towards the center of the press and liquid extruded out of the raw materials is discharged through the filtering holes formed in the outer drums 7 and 8 and is collected in a receptacle not show. Then the cakes are moved towards the center outlet 15.

During the operation of the continuous press, the raw materials are subjected to the compressing forces from the screw blades 5 and 6 towards the center. Then, to the screw drum 4 are applied, via the screw blades 5 and 6, repelling forces directing opposite to each other as shown by arrows A and B in the figure. Therefore, the repelling forces are cancelled each other and theoretically no thrust force is applied to the bearings 2 and 3. Further, the outlet 15 is provided at the center of the press and the cone-shaped plates 20 and 21 which serve to apply the pressing force to the cakes are provided at the outlet 15, and therefore the compressing forces producing the maximum repelling forces at the outlet 15 are substantially equal to each other so that the repelling forces are cancelled each other at the outlet 15. In fact, a small repelling force is applied to the driving shaft 1 due to fluctuation of the raw materials supplied from the inlets 13 and 14, but the maximum repelling forces produced at the center of the press become substantially equal to each other. Thus, according to the invention, the thrust bearings 2 and 3 can be made small and simple, while the stable operation of the press can be attained for a very long life time. Moreover, the maintenance and repair of the press can be materially simple and easy.

At the center outlet 15, the cakes are pushed outwardly in a radial direction and are introduced into a space between the cone-shaped plates 20 and 21. In this space, the cakes are further compressed by the cone-shaped plates and are discharged therefrom. When the cake pressure becomes higher than the pressure due to the springs 30 to 33, the cone-shaped plates 20 and 21 are moved outwardly against the spring force and then the cake pressure becomes smaller. In this manner, the cake pressure can be adjusted at will by means of the adjusting screws 34 to 37, so that the position in the press at which the raw materials are filled can be adjusted.

The present invention is not limited to the embodiment explained above, but many modifications and alternations can be conceived by those skilled in the art within the scope of the invention. For instance, in the embodiment the screw drum 4 is formed by a tapered tube and the screw blades 5 and 6 have the constant pitch. However, this is not always necessary and the screw drum may be formed by a drum having a constant diameter over its whole length and the screw blades may have a varying pitch decreasing towards the center of the screw drum.

As explained above in detail, in the continuous press according to the invention, at the central outlet where the maximum force is applied to the screw blades, the cakes are joined with each other and the repelling forces applied to both the screw blades balance, so that the thrust force applied to the driving shaft becomes very small. Therefore, the thrust bearings for journaling the driving shaft can be made much simpler and yet the usable duration of the press can be materially prolonged. Moreover, at the outlet the cakes are compressed with each other to increase the internal pressure of the cakes and thus the pressing or compressing efficiency becomes higher.

What is claimed is:

1. A continuous press comprising:

a frame;

a driving shaft journaled to the frame at its both ends by means of thrust bearings;

a screw drum disposed around the driving shaft to rotate therewith, said screw having a varying diameter which is gradually larger towards the center;

first and second screw blades symmetrically disposed around the outer surface of said screw drum, turning directions of the first and second screw blades being opposite to each other, said first and second screw blades having a constant pitch;

an outer drum arranged around the screw blades and having a number of small filtering holes;

first and second inlets provided in said outer drum for introducing raw materials into first and second spaces formed by the screw drum, first and second screw blades and outer drum, said spaces being gradually made smaller towards a center of the screw drum, said first inlet being provided in an end of said outer drum and said second inlet being provided in another end of said outer drum;

an outlet provided in said outer drum at its center for discharging the pressed raw material as cakes;

a pair of cone-shaped plates arranged in said outlet movably in a direction of the driving shaft; and a means for resiliently pressing the cone-shaped plates towards each other.

2. A continuous press according to claim 1, wherein said pressing means comprises coiled springs for pressing the cone-shaped plates towards each other and adjusting members for adjusting spring forces of the coiled springs.

* * * * *